United States Patent [19]

Seeger et al.

[11] 4,098,168

[45] Jul. 4, 1978

[54] MECHANICAL STRUCTURE

[75] Inventors: Hans Joachim Seeger, Bremen-Huchting; Ulrich Sorgatz, Wolfsburg, both of Germany

[73] Assignee: Vereinigte Flugtechnische Werke-Fokker G.m.b.H., Bremen, Germany

[21] Appl. No.: 80,519

[22] Filed: Sep. 15, 1970

[51] Int. Cl.[2] ..... F41F 3/04

[52] U.S. Cl. ..... 89/1.815; 89/1.819

[58] Field of Search ..... 89/1.8–1.819

[56] References Cited

U.S. PATENT DOCUMENTS

| | | | |
|---|---|---|---|
| 2,924,148 | 2/1960 | Fiedler et al. | 89/1.819 |
| 2,998,752 | 9/1961 | Couts | 89/1.819 |
| 3,082,396 | 3/1963 | Bernhard | 89/1.811 X |
| 3,132,590 | 5/1964 | Hall | 89/1.819 X |
| 3,225,655 | 12/1965 | Inglis | 89/1.816 |

*Primary Examiner*—David H. Brown

*Attorney, Agent, or Firm*—Spencer & Kaye

[57] ABSTRACT

An improved launching pad for guided missiles used to combat aerial targets, and in particular low-flying aircraft, which is provided with an arrangement for imparting an angular momentum to the missile about its transverse axis and in a direction toward a horizontal plane while the missile is still on the launching pad and accelerating.

3 Claims, 2 Drawing Figures

MECHANICAL STRUCTURE

BACKGROUND OF THE INVENTION

The present invention relates to an improved launching pad for guided missiles to combat airborne targets and in particular low-flying aircrafts.

In the defense against low-flying targets (aircraft, missiles, helicopters) there often arises the situation that the associated elevated observation unit (usually the antenna of a radar instrument) detects and follows a target, but that, at the given moment, obstacles, such as uneven terrain, growth or buildings utilized as camouflage, for example, are disposed in the path of flight of the missile for a hit using a line-of-sight method or a collision-course method. In order to employ the missile successfully, it is then necessary either to delay firing until the target has come closer and the necessary flight path is free of obstacles or the missile must be fired with a higher elevation immediately upon detection of the flying object and then guided in the direction toward the target.

Waiting for the target to come closer results in a reduction of the defense perimeter, possibly to the limits of the "inner dead zone", which is the area surrounding the firing location in which an approaching aerial target can be located without being able to be successfully attacked by a missile. The "inner dead zone" results from the fact that an aerial target which has penetrated to the immediate vicinity of the firing location can no longer be hit by a missile because the large curvature in the missile flight path, which may be required under certain circumstances due to the statistical deviations of the missile flight paths, would cause high transverse acceleration forces to be exerted on the missile which could thus overstress the structure of the missile. The magnitude of the "inner dead zone" thus depends on the speed of the approaching target and on the target finding method employed for the missile, and a redirection of the missile in the direction toward the target reduces the "inner dead zone".

In the above-mentioned air defense guidance weapons systems it is obviously desirable to have the "inner dead zone" as small as possible. Accordingly, to minimize the "inner dead zone", the missile must be brought as quickly as possible from the launching pad into an attack position which is defined by a predetermined height above the firing level and by a limited inclination of the longitudinal axis of the missile with respect to the horizontal. The height here approximately corresponds to that of the low-flying aerial target, and the permissible inclination for missiles with homing guidance systems depends on the viewing angle of the target finding head.

Substantially, three different modes of operation are known for the guidance of a missile:

1. The aerodynamic guidance may be realized by means of a fixed or controllable deflection of control surfaces disposed on the body of the missile which produces a turning of the missile, thus effecting a change in the path of flight via a change in the angle of incidence and the sweep action of the thrust vector. Since the aerodynamic forces, and thus also the control moment, increase with the square of the velocity, the path of flight is initially stretched out or straightened and later curved more strongly. This results, however — since the change in direction is effected at high speeds — in an increased mechanical stress on the structure of the missile due to heavy transverse acceleration forces. Moreover, with a fixed power phase for the driving system, the possible final speed, and thus the effective range of the missile, is reduced since the longitudinal inclination of the missile required for redirection with respect to the tangent of the path and the raised guide surfaces also increases the aerodynamic resistance of the missile.

2. A further possibility to initiate a control moment for the missile is by the sweep of the thrust vector. By changing the direction of the thrust jets, the effective line of the thrust no longer passes through the center of mass of the missile and thus produces a pitch moment which results in a pitching movement and thus a curvature in the flight path. After a desired period of flight, the thrust vector is then returned to the zero position by returning the thrust jets to their normal position. The difficulties of such an arrangement, however, lie in the requirement for very accurate alignment of the thrust jet. This is a result of the fact that, due to the large thrust involved, small angular deviations in the direction of this thrust cause great changes in the pitch moment and, since only slight control moments are necessary, slight angular deviations in the direction of thrust cause very strongly differing flight paths (dispersion).

3. One can also provide additional thrust jets which are disposed in a direction perpendicular to the longitudinal axis outside of the pitch axis, and which produce a constant transverse thrust and thus a pitch moment. The transverse thrust produced by these additional jets is then cut off after a desired duration of the power phase. This arrangement, however, requires additional constructive expenditures and results in a weight increase for the missile.

SUMMARY OF THE INVENTION

It is the object of the present invention to overcome the above-mentioned drawbacks and to redirect the missile in the low-speed range in order to thus keep the mechanical stresses on the missile, i.e. the acceleration values transverse to the longitudinal axis of the missile, at a minimum and to obtain an early attack position, i.e. to reduce the inner dead zone.

This is accomplished, according to the present invention, by imparting an angular momentum to the missile about its transverse axis when it is still on the launching pad and is being accelerated.

The angular momentum is imparted to the missile by means of a settable guiding arrangement provided on the launching pad in which the missile is suspended and from which it receives positive guidance in the firing direction during the acceleration of the missile. The guiding arrangement includes three guide rails disposed in the direction of flight of the missile with one of the guide rails being forward of the other two guide one of the guide rails being forward of the other two guide rails and being located along the longitudinal axis of the missile, while the two rearward guide rails lie on either side of the longitudinal axis of the missile. The guide rails are arranged so that the vertical projections of all three guide rails are parallel to one another, and the plane containing the longitudinal axis of the forward guide rail intersects the plane containing the longitudinal axes of the two rearward guide rails in a horizontal line and encloses an acute angle therebetween. The two rearward guide rails are pivotal about a common horizontal axis disposed perpendicular to the firing direction.

BRIEF DESCRIPTION OF THE DRAWINGS

FIG. 2 is a view of the missile and launching pad of FIG. 1 in the direction of the arrow X.

DESCRIPTION OF THE PREFERRED EMBODIMENTS

Figure 1:
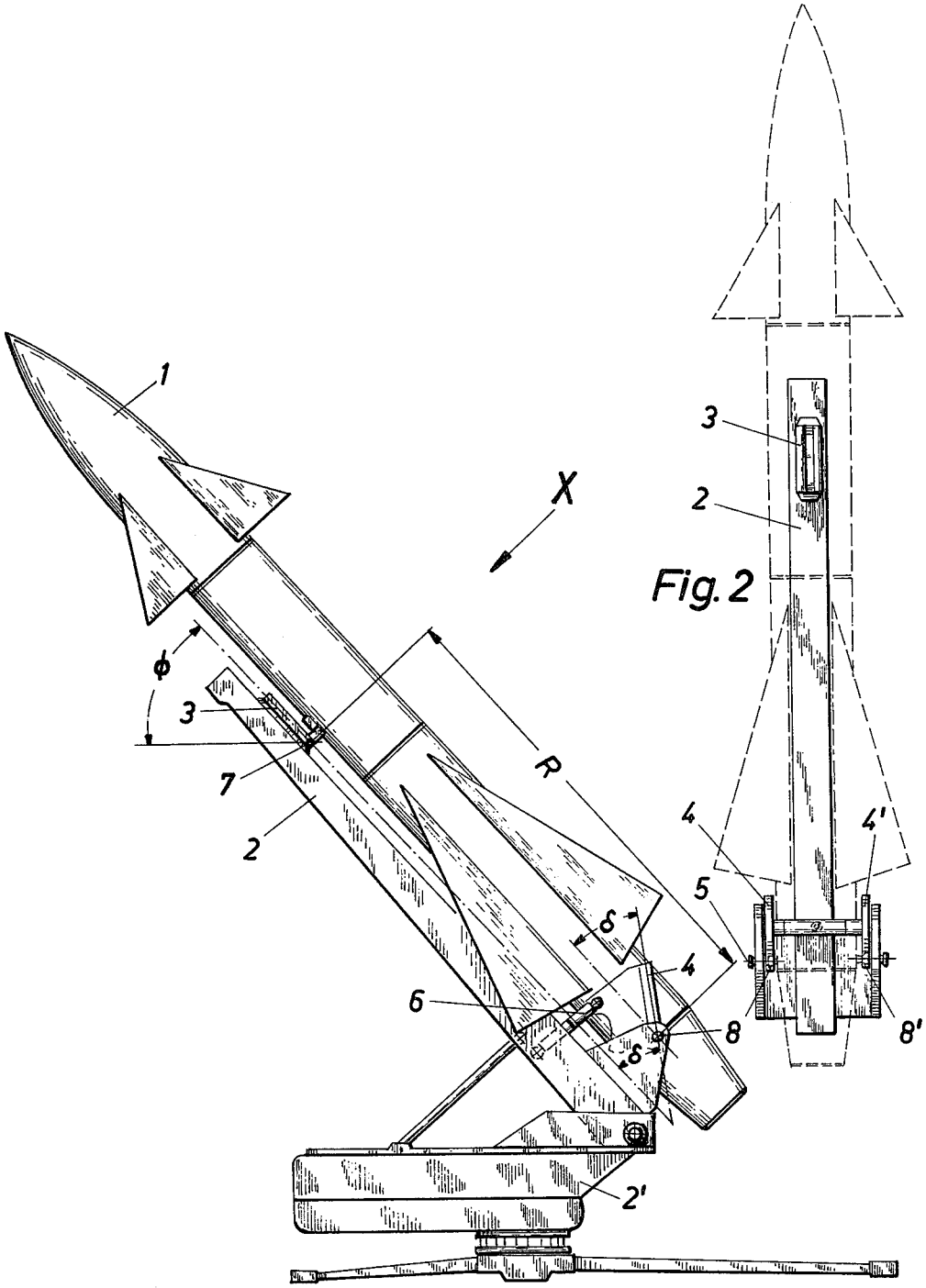
FIG. 1 is a side elevation of a guided missle resting on an improved launching pad according to the invention.

Referring now to FIGS. 1 and 2, there is shown a missile 1 mounted on a launching pad 2 which is pivotally mounted in the conventional manner on a base 2'. According to the invention, the launching pad 2 is provided with three guide rails 3, 4 and 4' for the missile 1 with the guide rails 4, 4' being located behind the guide rail 3 in the direction of flight. The guide rail 3 is fixedly mounted on the launching pad 2 and located thereon so that it is beneath the longitudinal axis of the missile. The two rearward guide rails 4, 4', on the other hand, are located on either side of the missile 1 and are mounted on the launching pad 2 so that they are pivotal in unison about a horizontal axis 5 which is perpendicular to the firing direction of the missile 1. The three guide rails 3, 4, and 4' are arranged such that their vertical projections are at all times parallel to one another and so that the two planes containing the longitudinal axis of the guide rail 3 and the longitudinal axes of the guide rails 4, 4', respectively, intersect in a horizontal line and enclose an acute angle $\delta$. The inclination of the guide rail 4, 4', and hence the value of the angle $\delta$, is set by means of a cylinder 6, which may, for example, be hydraulic.

The missile 1 is mounted on the launch pad 2 by means of three suspension points 7, 8, 8' which engage the guide rails 3, 4 and 4' respectively. These suspension points 7, 8 and 8' may be designed, for example, as rollers or slides which engage the respective guide rails and are moved therealong during the acceleration of the missile. The frontal point of suspension 7 and the rearward points of suspension 8, 8' of the missile 1 are disposed at a predetermined fixed distance R from one another.

Referring now to the explanation of the operation of the improved launching pad according to the invention, when the missile 1 is fired, the resulting thrust will accelerate the missile 1 in the direction of the positive guidance provided by the guide rails 3, 4 and 4' on the missile suspension points 7, 8 and 8', respectively.

The resulting movement of the missile can be understood as a translation in the firing direction which is defined by the firing angle $\phi$, and as a rotation about the horizontal axis which passes through the points of suspension 7 in the firing direction. The rotation is here effected by the inclined guide rails 4, 4', which impart a movement component to the missile suspension points 8, 8' disposed therein in a direction perpendicular to the longitudinal axis of the missile 1. The missile 1 thus receives an angular momentum on the launching pad 2 which, at a certain acceleration, is dependent on the angle of inclination $\delta$ of the guide rails 4, 4', the spacing R between the front and rear suspension points 7, and 8, 8', and, of course, the mass inertia moment of the missile 1 about its transverse axis. Once the missile leaves the guide rails 3, 4 and 4' of the launching pad 2, the missile 1 goes into free flight, i.e. it then has six degrees of freedom of movement, and the pitch angle velocity is reduced by the aerodynamic pitch moment of the missile which increases with the square of the flight speed. The missile thus rotates back about its pitch axis in the direction of the flight path tangent. As a result, the initially strong curvature of the flight path decreases with increasing flight velocity of the missile 1.

The realizable advantage of the present invention is thus that the arrangement on the launching pad 2 according to the invention for producing an angular momentum about the pitch axis of the missile effects a redirection of the missile in the low-speed range. This results in low mechanical stresses on the missile structure because of the small acceleration values transverse to the longitudinal axis of the missile.

Additionally, the realizable final speed in the acceleration phase and thus the effective range of the missile is greater with redirection in the low-speed range according to the invention than with aerodynamic redirection in the high-speed range after initial flight without pitch as in the prior art since the aerodynamic resistance is less. The increased final speed, moreover, permits earlier interception of an approaching target, and under certain circumstances even the interception of a plurality of targets, before they have reached the inner dead zone.

The present invention provides still the further advantage that the reproduceability of a desired flight path with the identical chronological sequence of the thrust is very good since the distance R and inclination angle $\delta$ of the guide rails 3, 4, 4' can be very accurately set. In addition, weight and expenses are saved per missile since the solution of the present invention does not require any additional constructive and control measures in the missile itself (such as, for example, is required for guidance by means of the thrust vector sweep).

Moreover, the early redirection of the missile with the resulting heavy curvature at the beginning of the flight path has the additional advantage, when compared with the initially straighter flight paths utilized in the prior art guidance arrangements, that the ideal flight path can be achieved according to which the missile can fly over camouflage and obstacles at short distances and can thus reach the attacking position very quickly.

Additionally, an adaptation to the actual starting conditions can be achieved by a very simple adjustment of the guide rails, which requires less adjustment manipulation and less time when compared with an adjustment of the entire launching pad.

It will be understood that the above description of the present invention is susceptible to various modifications, changes and adaptations and the same are intended to be comprehended within the meaning and range of equivalents of the appended claims.

We claim:

1. In a launching pad for a guided missile to combat aerial targets, and particularly low-flying aircraft, said launching pad being inclined with respect to the horizontal plane by an angle $\phi$, the improvement comprising: means mounted on said launching pad for imparting a predetermined desired angular momentum to the missile about its transverse axis and in a direction toward a horizontal plane while the missile is on the launching pad and accelerating, said means including three guide rails for engaging three suspension members on the guided missile to suspend the missile, said guide rails being disposed in the direction of flight to positively guide the missile during acceleration, one of said guide rails being further forward in the direction of flight than the other two guide rails and being fixedly mounted on said launching pad, said other two guide rails being mounted so that they are simultaneously pivotal about a horizontal axis which is disposed perpendicular to the firing direction, the vertical projections of said guide rails being parallel to one another with the two planes including the longitudinal axis of said forward guide and the longitudinal axes of said other two guide rails, respectively, intersecting in a horizontal line and enclosing an acute angle $\delta$, and said other two guide rails being inclined with respect to the firing direction of the missile such that the angle of inclination of said other two guide rails with respect to the horizontal plane is equal to the sum of the angles $\delta$ and $\phi$.

2. The improvement as defined in claim 1 wherein said forward guide rail is mounted on said launching pad so as to engage a suspension member on the missile located along the longitudinal axis of the missile and wherein said other two guide rails are symmetrically disposed on said launching pad to engage respective suspension members extending laterally from the missile.

3. The improvement as defined in claim 1 including means for adjusting the pivotal position of said other two guide rails to vary the angle $\delta$ and thereby adjust the said angular momentum imparted to the missile.

* * * * *